US011383798B2

(12) United States Patent
Wilson et al.

(10) Patent No.: US 11,383,798 B2
(45) Date of Patent: Jul. 12, 2022

(54) FLOATING POINT POWER TOWER FOR A BOAT

(71) Applicant: Roswell Canada Inc., Acheson (CA)

(72) Inventors: Darrick Wilson, Edmonton (CA); Richard Behnke, Edmonton (CA)

(73) Assignee: ROSWELL CANADA INC., Acheson (CA)

( * ) Notice: Subject to any disclaimer, the term of this patent is extended or adjusted under 35 U.S.C. 154(b) by 0 days.

(21) Appl. No.: 16/436,480

(22) Filed: Jun. 10, 2019

(65) Prior Publication Data

US 2019/0375484 A1 Dec. 12, 2019

Related U.S. Application Data

(60) Provisional application No. 62/682,373, filed on Jun. 8, 2018.

(51) Int. Cl.
*B63B 34/67* (2020.01)

(52) U.S. Cl.
CPC ..... *B63B 34/67* (2020.02)

(58) Field of Classification Search
CPC ..... B63B 34/67
See application file for complete search history.

(56) References Cited

U.S. PATENT DOCUMENTS

| | | | | |
|---|---|---|---|---|
| 7,392,758 | B2 * | 7/2008 | Metcalf | B63B 17/00 114/364 |
| 7,438,015 | B1 * | 10/2008 | Schwindaman | B63B 17/02 114/361 |
| 8,297,484 | B2 * | 10/2012 | Jesewitz | B63B 32/80 224/406 |
| 8,752,498 | B1 * | 6/2014 | Schwindaman | B63B 17/02 114/361 |
| 9,114,854 | B2 * | 8/2015 | Williams | B63B 21/56 |
| 9,434,451 | B1 * | 9/2016 | Ostmeyer | B63B 17/02 |
| 10,272,974 | B2 * | 4/2019 | Hord | B63B 34/67 |
| 10,286,982 | B2 * | 5/2019 | Sheedy | B63B 17/02 |
| 10,562,595 | B2 * | 2/2020 | Williams | B63B 17/02 |
| 2014/0048007 | A1 * | 2/2014 | Williams | B63B 34/67 114/361 |
| 2014/0261143 | A1 * | 9/2014 | Williams | B63B 17/02 114/361 |
| 2019/0061882 | A1 * | 2/2019 | Hord | B63B 34/67 |
| 2019/0375484 | A1 * | 12/2019 | Wilson | B63B 34/67 |

* cited by examiner

*Primary Examiner* — S. Joseph Morano
*Assistant Examiner* — Jovon E Hayes
(74) *Attorney, Agent, or Firm* — Timothy H. Van Dyke; Wolter, Van Dyke, Davis, PLLC

(57) ABSTRACT

An apparatus may include a tower configured to be mounted to a boat. The apparatus may further include an actuation assembly, wherein the actuation assembly may include a linkage extending between a folding portion of the tower and at least one respective base for moving the tower between a first position and a second position.

14 Claims, 9 Drawing Sheets

Tower in Folded Position
(600)

100

FLOATING POINT POWER TOWER FOR A BOAT

CROSS-REFERENCE TO RELATED APPLICATION

This application claims the benefit of U.S. provisional patent application Ser. No. 62/682,373, entitled "Floating Point Power Tower for a Boat," filed on Jun. 8, 2018, the entire disclosure of which is incorporated herein by reference.

FIELD OF THE INVENTION

The present invention generally relates to a tower or arch like structure that may be mounted to a boat. More particularly, the tower may be used for towing an individual participating in watersports.

BACKGROUND OF THE INVENTION

Wakeboarding is one of the most popular water sports in the world. By anchoring the towline at a high elevation above the boat deck, there is a greater ability of the performer to be lifted higher into the air, whether with a ski or wakeboard. Wakeboarding performance may be improved by using a vessel which is fitted with a towing structure having spaced supports attached on opposite sides of the vessel while coupling upper extremities of the supports with a bridging portion, to which a towrope attachment point is fitted.

BRIEF SUMMARY OF DISCLOSURE

In one example implementation, an apparatus may include a tower configured to be mounted to a boat. The tower may include a first side support and a second side support. Each of the first side support and second side support may be pivotally connected at a respective base. The apparatus may also include an actuation assembly. The actuation assembly may include a linkage extending between a folding portion of the tower and at least one of the respective bases for moving the tower between a first position and a second position.

One or more of the following example features may be included. The first side support and the second side support may be respectively positioned at opposing ends of a center section of the tower. The actuation assembly may be disposed in at least one of the first side support and the second side support. The actuation assembly may further include an actuator coupled to the folding portion of the tower. The coupling between the actuator and the folding portion may provide pivotal movement between the actuator and the folding portion as the tower moves between the first position and the second position. The linkage may include a flexible tether coupled to and extending between the actuator and the respective base of the tower. The center of gravity of the tower may be longitudinally displaced from the pivotal connection toward a direction of movement of the tower between the first position and the second position. The linkage may extend on a longitudinally opposed side of the pivotal connection relative to the center of gravity of the folding portion of the tower. The folding portion of the tower may be positioned in a raised configuration in the first position. The folding portion of the tower may be positioned in a folded configuration in the second position. The first side support and the second side support may be configured to position the center section at a first height above a deck of the boat in the first position, and at a second height above the deck of the boat in the second position. The first height may be a greater distance from the deck of the boat than the second height. The first side support and the second side support may be configured to position the center section at a plurality of heights relative to the deck of the boat as the tower moves between the first position and the second position.

In another example implementation, an apparatus may include a tower configured to be mounted to a boat. The tower may include a first side support and a second side support. Each of the first side support and second side support may be pivotally connected to a respective base. The apparatus may include an actuation assembly. The actuation assembly may include a linkage extending between a folding portion of the tower and at least one of the respective bases for moving the tower between a first position and a second position. The actuation assembly may further include an actuator coupled to the folding portion of the tower. The coupling between the actuator and the folding portion may provide pivotal movement between the actuator and the folding portion as the tower moves between the first position and the second position.

One or more of the following example features may be included. The linkage may include a flexible tether coupled to and extending between the actuator and the respective base of the tower. A center of gravity of the tower may be longitudinally displaced from the pivotal connection toward a direction of movement of the tower between the first position and the second position. The flexible tether may extend on a longitudinally opposed side of the pivotal connection relative to the center of gravity of the folding portion of the tower. The folding portion of the tower may be positioned in a raised configuration in the first position. The folding portion of the tower may be positioned in a folded configuration in the second position.

In another example implementation, an apparatus may include a tower configured to be mounted to a boat. The tower may include a first side support and a second side support. Each of the first side support and second side support may be pivotally connected to a respective base. The tower may also include an actuation assembly for moving the tower between a first position and a second position. The actuation assembly may include an actuator coupled to a respective base. The actuation assembly may also include a linkage extending between the actuator and a folding portion of the tower.

One or more of the following example features may be included. The linkage may include a flexible tether coupled to and extending between the actuator and the folding portion of the tower. A center of gravity of the tower may be longitudinally displaced from the pivotal connection toward a direction of movement of the tower between the first position and the second position.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

Figure 1:
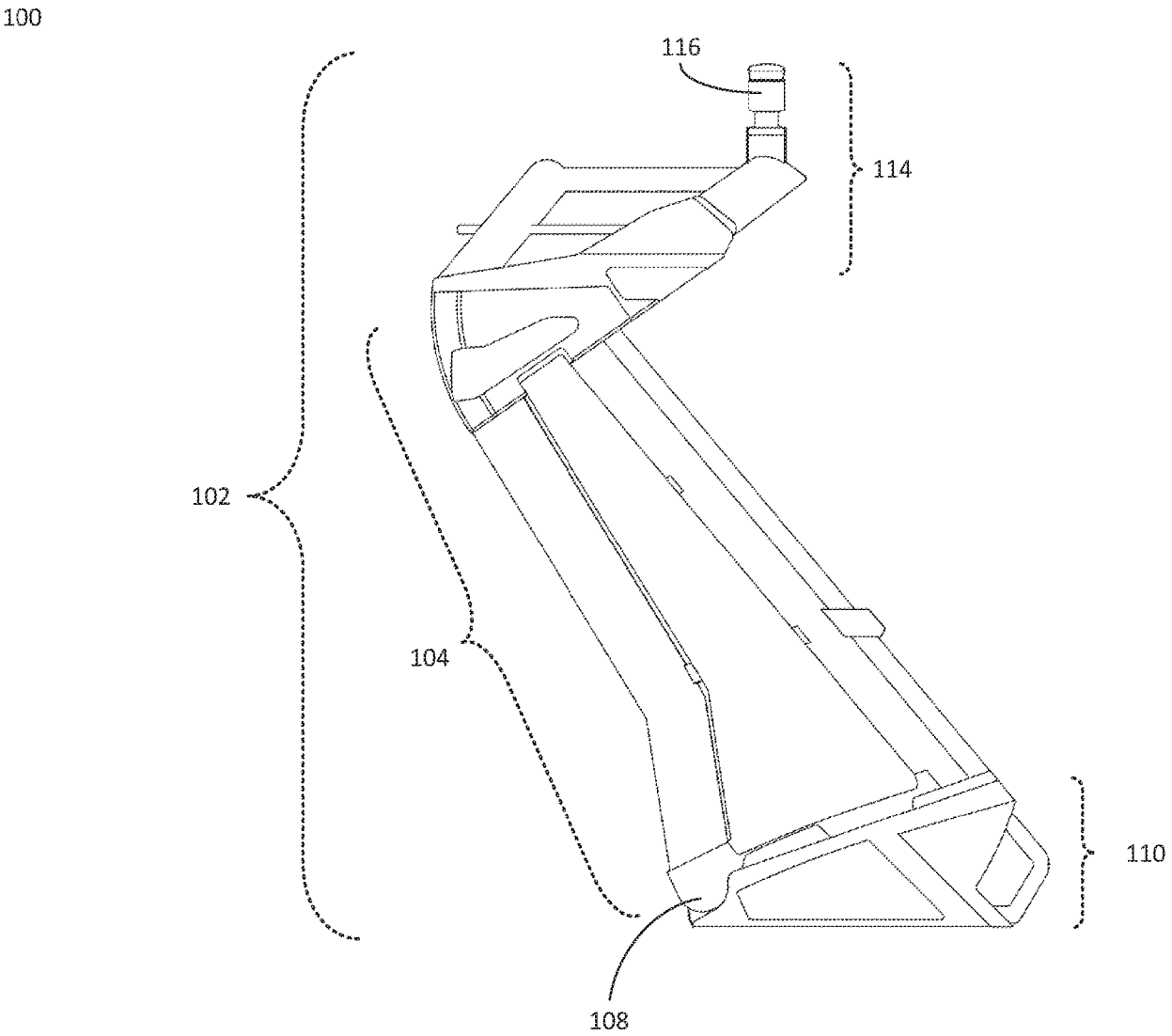
FIG. 1 is a side view of an illustrative example embodiment of a boat tower in a raised position.
Figure 2:
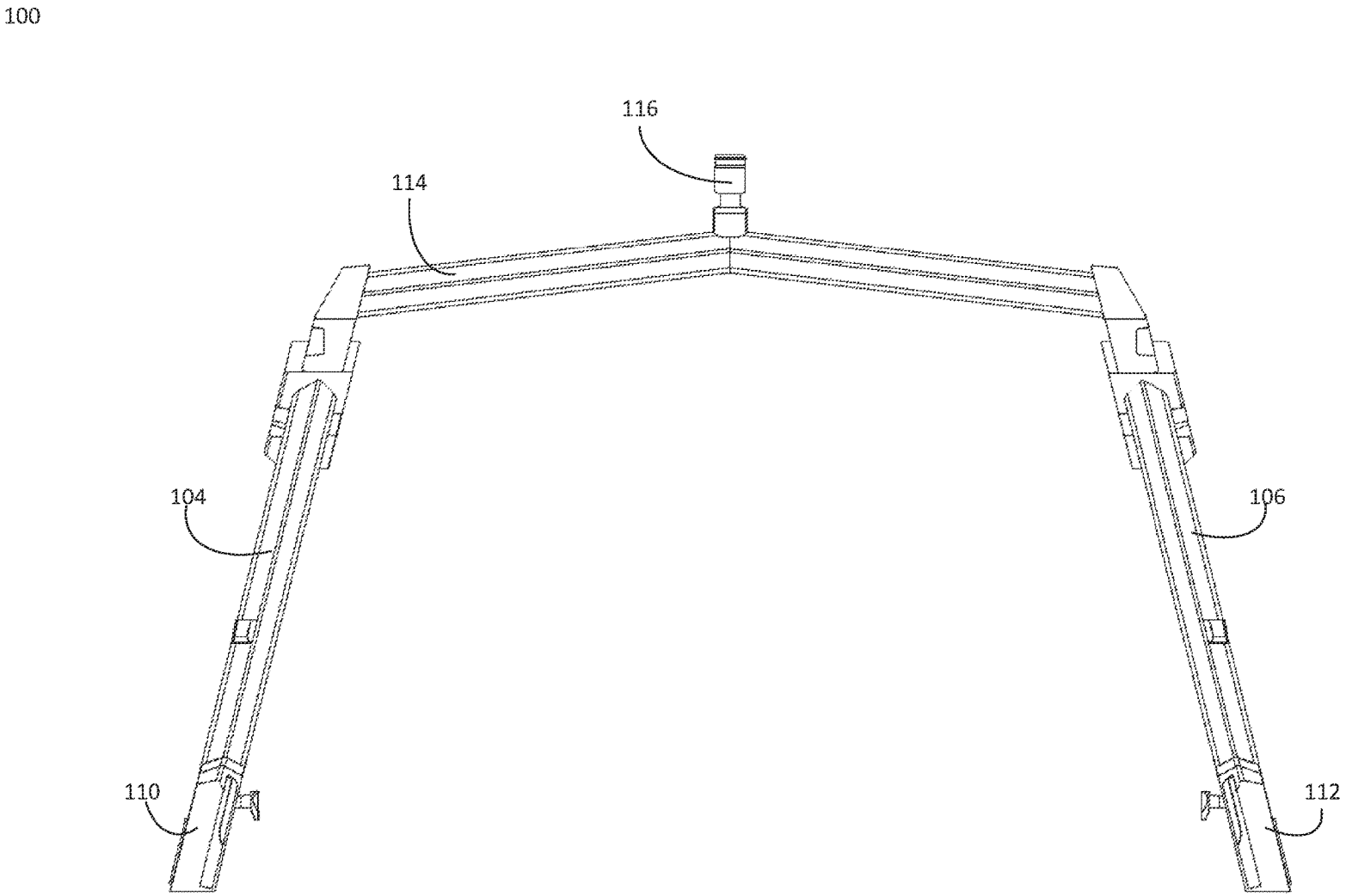
FIG. 2 is a front view of the illustrative example embodiment of the boat tower of FIG. 1 in the raised position.
Figure 3:
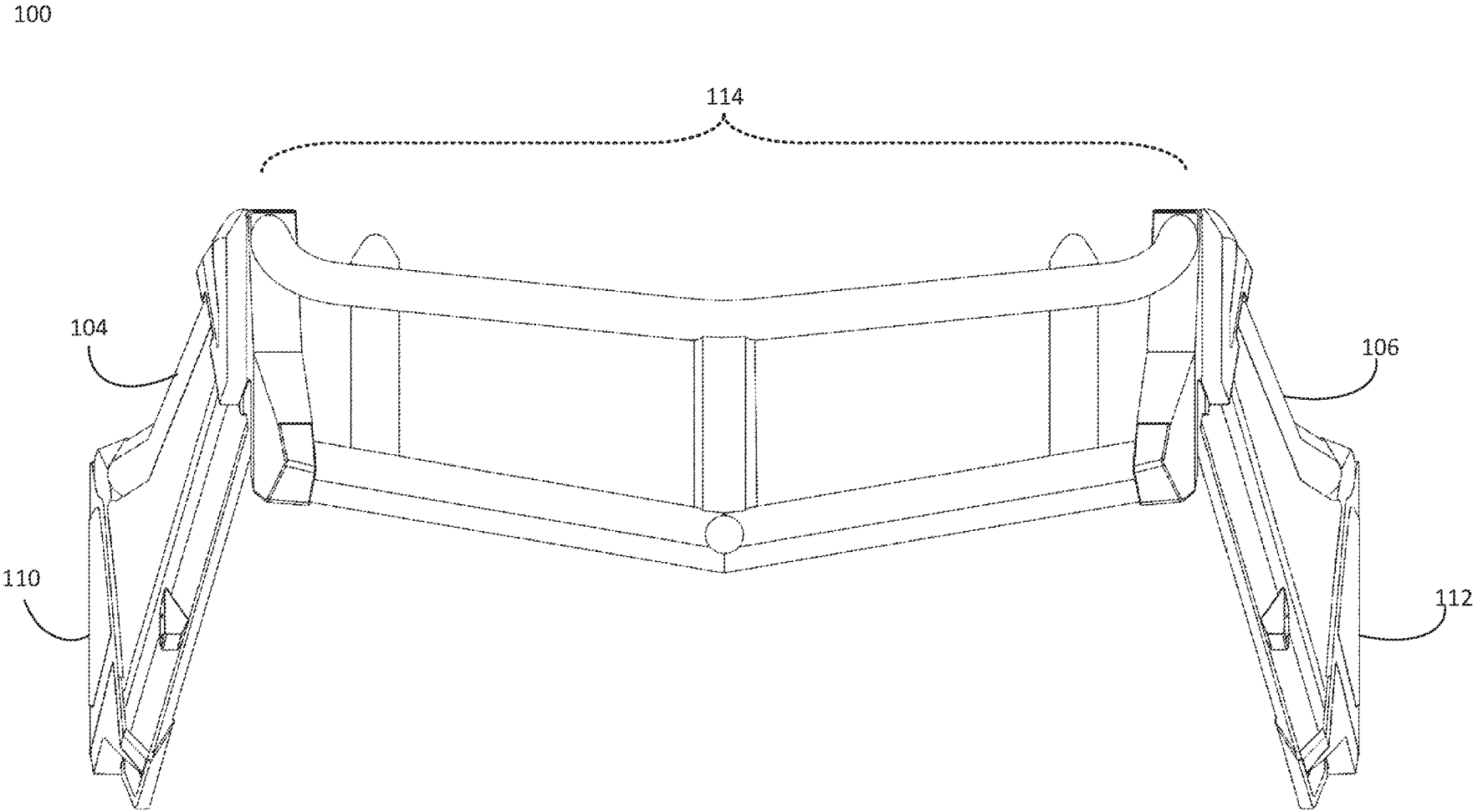
FIG. 3 is a top view of the illustrative example embodiment of the boat tower of FIG. 1 in the raised position.
Figure 4:
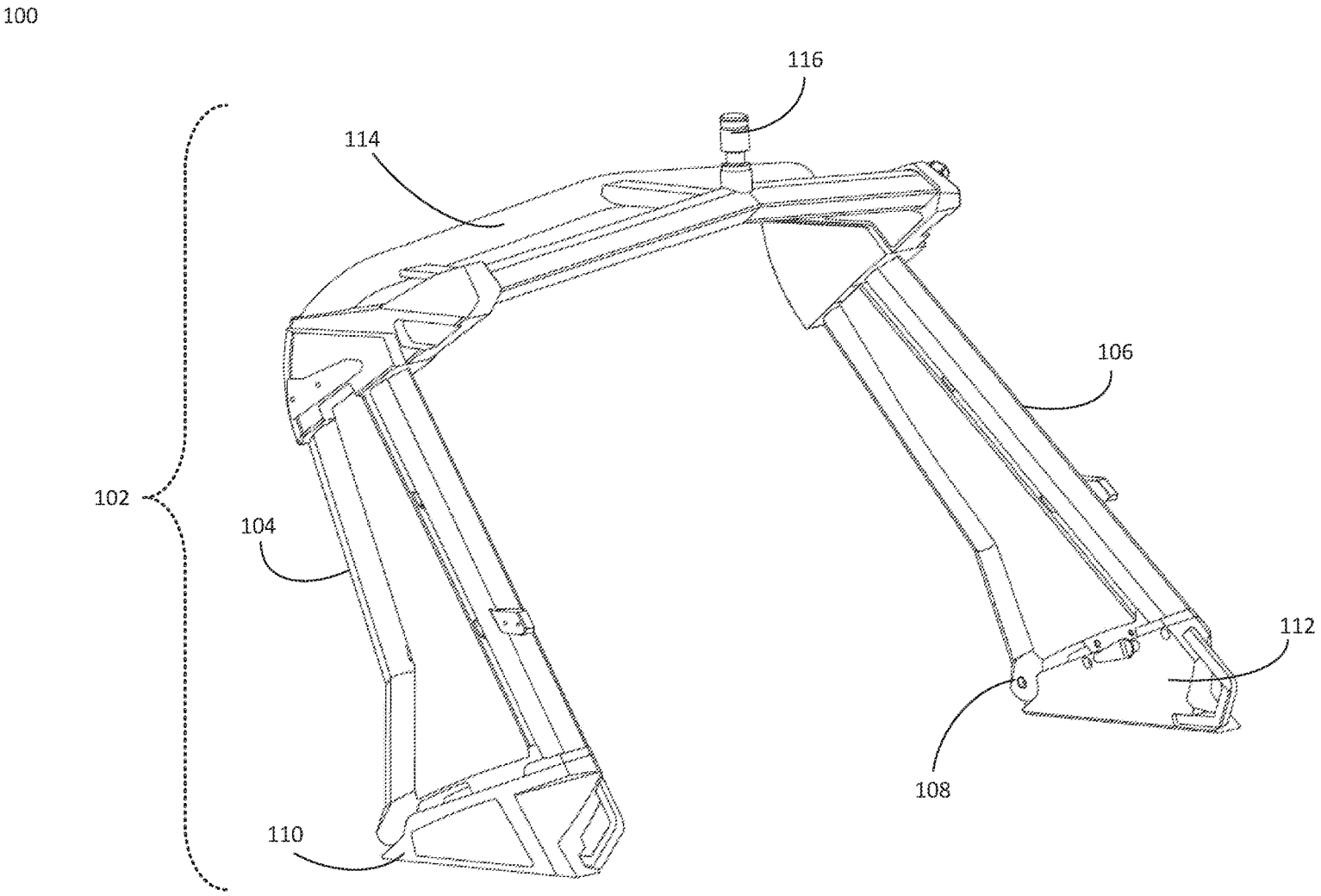
FIG. 4 is a perspective view of the illustrative example embodiment of the boat tower of FIG. 1 in the raised position.
Figure 5:
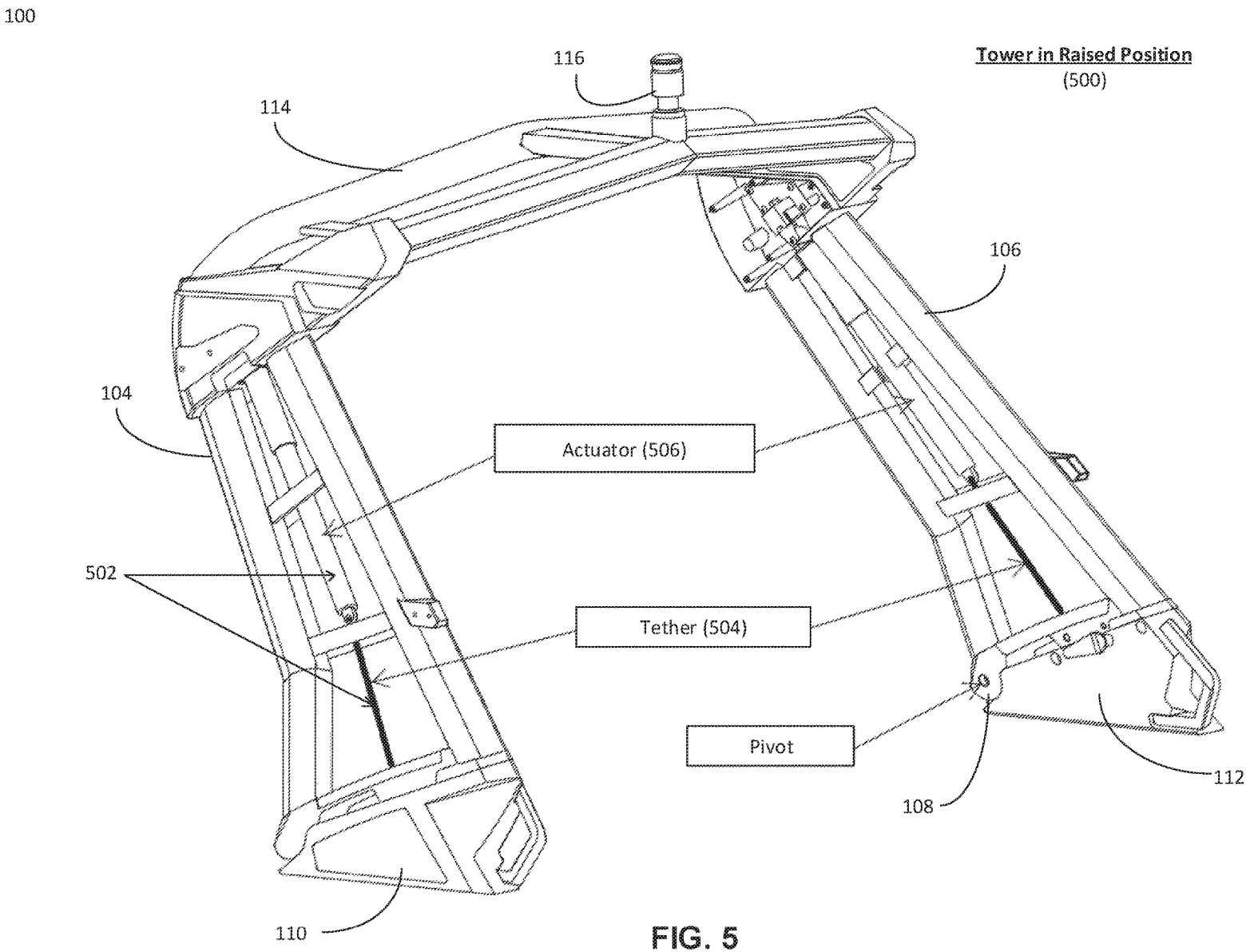
FIG. 5 is perspective view of the illustrative example embodiment of the boat tower of FIG. 1 in a raised position with the covers of the side supports removed and/or transparent.

Referring to FIGS. 1-9, there is shown various views of towing structure 100. Examples of towing structure 100 may include, but is not limited to, a watersports tower that may be mounted to and used on various types of boats, general and specific in use, including wakeboard, surf, waterski, family, cruiser, run-abouts, fish boats, pontoon and other deck boats of the like. It will be appreciated that the towing structure 100 may be used on various sizes of boats including, but not limited to, power boats 17' to 50'. In some implementations, towing structure 100 may be used for aiding in equipment storage, aiding in a Bimini system, or any combination thereof. As also noted above, in some implementations, towing structure 100 may include and/or may be configured to be used in conjunction with a Bimini top (e.g., by providing partial and/or complete mounting points for a Bimini, and/or by including an integrated Bimini, etc.). Example embodiments of towing structure 100 that are configured to be used in conjunction with a Bimini and/or configured to include a Bimini may include various additional features and/or combinations of features that may include and/or partially support or mounts a Bimini and/or windshield cover system.

With continued reference to the example implementations of FIGS. 1-9, an example of towing structure 100 may include tower 102, which may be configured to be mounted to a boat. Tower 102 may include first side support 104 and second side support 106. Each of the first side support 104 and the second side support 106 may be pivotally connected 108 at a respective base 110, 112. The towing structure may also include actuation assembly 502. Actuation assembly 502 may include linkage 504 extending between folding portion 602 of tower 102 and at least one of the respective bases 110, 112, for moving tower 102 between first position 500 and second position 600.

As generally discussed above, towing structure 100 may include tower 102 configured to be mounted to a boat. Tower 102 may include first side support 104 and second side support 106. Each of the first side support 104 and the second side support 106 may be pivotally connected 108 to a respective base 110, 112. For example, a pivot may be associated with, and may act between, first side support 104 and first respective base 110, and a pivot may be associated with, and act between, second side support 106 and second respective base 112. Pivotal connection 108 may include any suitable structure to allow pivotal movement of the tower 102 relative to the deck of the boat, including, but not limited to, hinge structures, pivot pins, trunnions, etc. While in the illustrated example embodiment the tower 102 is depicted as being pivotally mounted via respective bases laterally spaced toward either side of a boat, it will be appreciated that the tower may be pivotally coupled via other mounts to the boat, including, but not limited to, being directly pivotally mounted to the deck of the boat, to a support structure underlying the deck of the boat, to a gunwale feature of the boat, and/or to other suitable features of the boat and/or mounts associated with the boat. As will be elaborated upon in greater detail below, tower 102 may be raised and lowered, for example, between a first, e.g., raised position that may be suitable for towing an individual participating in a watersport, and a second, e.g., lowered position, which may, for example, reduce the overall height of the boat. Reducing the overall height of the boat may, in some situations, facilitate storage and/or transportation of the boat (e.g., via trailering or the like), and/or reduce the air draft of the boat (e.g., to facilitate passing under low bridges or other overhead obstructions). For example, tower 102 may be configured to integrate Bimini Tops, Platforms, Audio systems, and a storage apparatus. Each of the first side support 104 and the second side support 106 may be mounted to the boat (e.g., to the deck of the boat).

In some implementations, towing structure 100 may include actuation assembly 502. For example, actuation assembly 502 may include linkage 504 extending between folding portion 602 of tower 102 and at least one of the respective bases 110, 112, for moving tower 102 between first position 500 and second position 600. For example, an illustrative example embodiment of tower 102 consistent with the present disclosure is shown, in which FIGS. 5-8 may variously depict views of the example tower 102 showing an example embodiment of an actuation configuration that may be implemented to move tower 102 between the raised position and the lowered, or folded, position. For instance, tower 102 may include linkage 504 extending between folding portion 602 of tower and stationary portion 604 of tower 102 (such as a stationary/non-folding portion of the two side supports, respective bases through which the tower is mounted to the boat, and/or the deck or substructure of the boat). While the illustrated example embodiment is shown including two actuation assembles, with one actuation assembly associated with each of the side supports 104, 106, in some implementations, only a single actuation assembly, associated with only one of the side supports may be utilized. Additionally, while the illustrated example depicts the actuation assemblies within the side supports, in other implementations, the actuation assemblies may be disposed at least partially within the respective bases, at least partially below a deck of the boat, and/or associated with another portion or structure of the boat. In such an implementation, the actuation assembly may be coupled to the folding portion of the tower by way of the linkage. The raising and folding of the tower may operate in a generally similar manner as when the actuation assembly is within the side supports.

Consistent with the present disclosure, actuation assembly 502 may include actuator 506 that may be associated with linkage 504 for moving tower 102 (e.g., specifically the folding portion 602 of the tower) between the raised position (i.e., first position 500) and the folded position (i.e., second position 600). For example, actuator 506 and linkage 504 may act between folding portion 602 of tower and stationary portion 604 of tower 102 to effectuate raising and folding of tower 102.

In some implementations, first side support 104 and second side support 106 may be respectively positioned at opposing ends of center section 114 of the tower. For example, center section 114 may be supported above a deck of a boat by first side support 104 and second side support 106, with one side support generally located adjacent the two opposed sides of the boat. Consistent with this configuration, each of the first side support 104 and second side support 106 may be mounted to the boat (e.g., to the deck of the boat and/or to other structural features of the boat). In some implementations, the first and second side supports 104, 106 may be mounted to the boat by respective base features (e.g., base features 110, 112). Center section 114 may also include one or more tow heads 116 to which a tow rope may be attached and used by an individual participating in a given watersport.

As will be elaborated upon in greater detail, tower 102 may be raised and lowered by a folding action, e.g., about a respective pivot associated with each of the two side supports. By way of the folding action, center section 114, and at least a portion of each of the two side supports, may pivot to move tower 102 between a raised position (i.e., raised configuration) and a lowered position (i.e., folded configuration). It will be appreciated that, while the description herein references center section 114 and first side support 104 and second side support 106, such designations are intended to identify the general location and nature of aspects of tower 102. For example, in some embodiments, tower 102 may include an arch or a continuous structure, which may not include a discretely delineated "center section" and "side supports." Rather, the side supports and the center section may include a single and/or integral structure. Such embodiments are also contemplated by the present disclosure.

As generally mentioned above, in some implementations, actuation assembly 502 may be disposed in at least one of first side support 104 and second side support 106. For example, and with particular reference to FIGS. 5-6 and FIGS. 8-9, an illustrative example embodiment of a folding tower consistent with the present disclosure is shown with an interior of the two side supports exposed (e.g., through the removal/transparent rendering of side covers or pieces of tower). In such an implementation, the actuation assembly may be completely and/or at least partially disposed within the thickness of each respective side support. Accordingly, the actuation assembly may be at least partially housed within a respective side support. In such an arrangement, the actuation assembly may be protected against from interference by foreign objects and/or the risk of injuring a user or bystander from inadvertent contact with the actuation assembly (e.g., during operation of the actuation assembly). It will be appreciated that other configurations may also be utilized. For example, in some embodiments, the actuation assembly may be partially, and to fully, disposed within one, or both, of the respective bases and/or disposed beneath one, or both, of the bases (e.g., below a deck of the boat, or disposed in another suitable location).

In some implementations, actuation assembly 502 may include actuator 506 coupled to folding portion 602 of tower 102. In some embodiments, the coupling between actuator 506 and folding portion 602 may provide pivotal movement between actuator 506 and folding portion 602 as tower 102 moves between first position 500 and second position 600. For example, actuator 506 may include an extendable actuator, such as a linear actuator, a hydraulic and/or pneumatic piston, or other suitable actuator. In some embodiments, the actuator may include a power driven winch (electrical, hydraulic, and/or pneumatic), a motorized crank assembly, etc. An actuator 506 may be disposed within folding portion 602 of each of the first side support 104 and the second side support 106 (in an implementation including two actuation assemblies). An upper end (relative to the position within tower in the raised position) of actuator 506 may be coupled to folding portion 602 of tower 102. The pivotal movement provided by the coupling between the actuator 506 and the folding portion of the tower 602 may allow the line of action of the actuator to remain generally aligned with a line of force through the linkage during the folding movement of the tower. For example, as the folding portion of the tower 602 folds away from the bases (or other mounting structure or feature), the actuator may pivot to maintain a linear line of action from the point of attachment of the actuator with the tower to the engagement between the linkage and the respective base(s) (and/or stationary portion of the tower, or other mounting feature). It will be appreciated that while in some embodiments the coupling between actuator 506 and folding portion 602 of tower 102 may provide at least some degree of pivotal movement between actuator 506 and folding portion 602 of tower 102, in other embodiments actuator 506 may be rigidly coupled relative to folding portion 602 of tower 102.

Additionally, as mentioned above, rather than being disposed within the side supports, in some implementations the actuation assembly 502 may be disposed on one or more of the respective bases and/or may be disposed below the respective bases (e.g., below a deck of the boat and/or within another portion of the boat). In such an embodiment, the actuator(s) may be coupled with the respective base(s) and/or another structure of the boat, and the linkage may be engaged with the folding portion of the tower. Similar with the previously discussed embodiment, the actuator may be operated to allow the tower to move between the folded and unfolded positions.

In some implementations, linkage 504 may include a flexible tether coupled to and extending between actuator 506 and respective base 110, 112 of tower 102 (and or to other suitable structure of the boat and/or other suitable structure attached to the boat). In some embodiments, the flexible tether may be redirected around a pulley associated with the respective bases, and then coupled to another structure (including, but not limited to, the folding portion of the tower). A generally corresponding arrangement may be implemented in an embodiment in which the actuator is coupled to the base(s), or another structure, rather than the folding portion of the tower. Examples of suitable flexible tethers may include, but are not limited to, rope, cable, web tethers, extruded filaments and/or leashes, etc. An example of a suitable rope tether may include high strength ropes such as ultra-high molecular weight polyethylene rope (e.g., Dyneema or Spectra), aramid rope (e.g., Kevlar or Technora), liquid crystalline polymer (e.g., Vectran), as well as more conventional polyester or nylon ropes. It will be appreciated that various additional and/or alternative ropes or tethers may be utilized consistent with the present disclosure. Additionally, it will be appreciated that in some implementations the linkage may include a rigid member, such as a metal rod or the like. In some further implementations, the linkage may include a feature of the actuator, such as piston rod, or other extensible feature of the actuator.

With continued reference to the illustrated embodiment, linkage 504 may be coupled to a lower end of actuator 506 (e.g., an end opposite the coupling between actuator 506 and folding portion 602 of tower 102), and may extend between actuator 506 and stationary portion 604 of tower 102 (e.g., a portion of the two side supports below pivot, the base portion, and/or a structure of the boat below the base portion). In an implementation in which the actuator(s) may be coupled to and/or disposed within the base(s) (and/or below the deck of the boat and/or to other structure of the boat), the linkage may be coupled to the actuator(s) and may extend between the actuator(s) and the folding portion of the tower.

Figure 7:
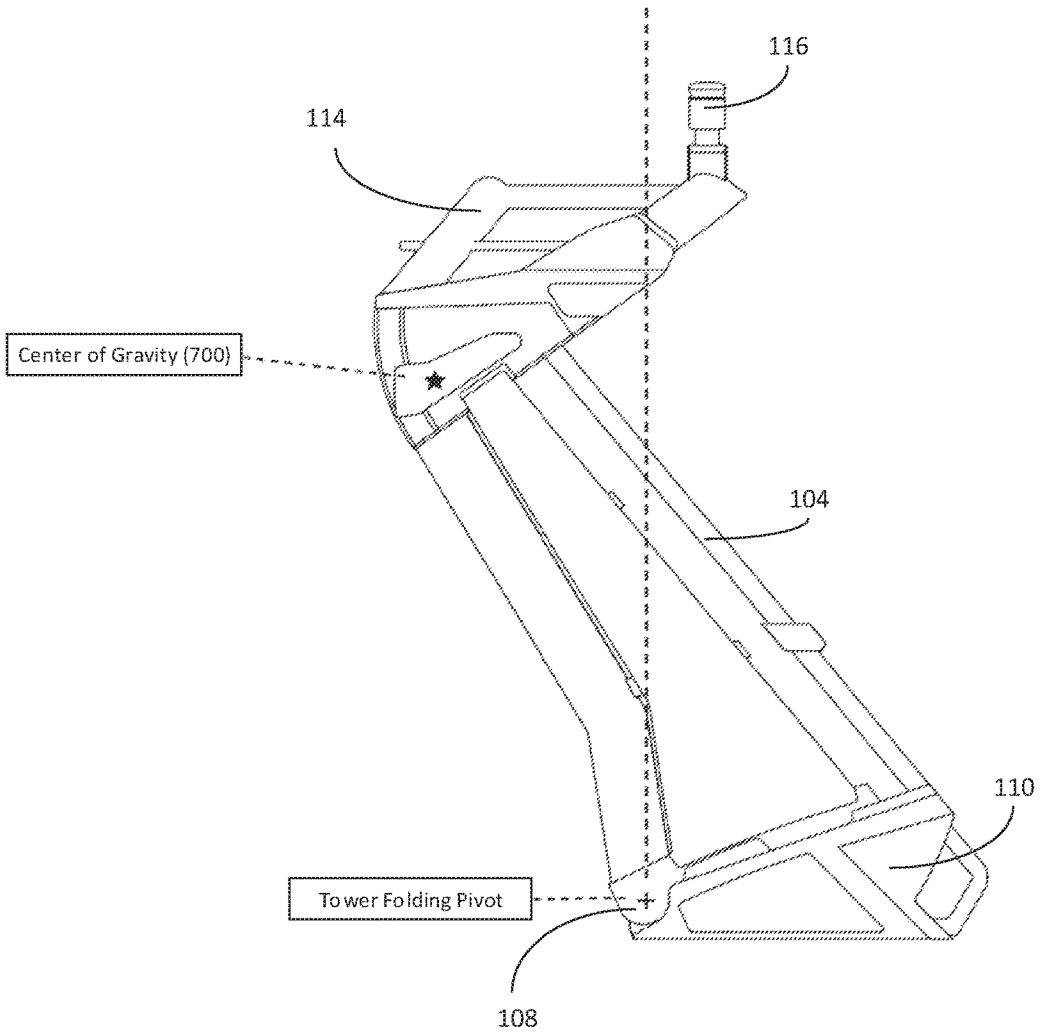
FIG. 7 diagrammatically depicts a relationship between the center of gravity of the foldable portion of the tower relative to the pivots of the illustrative example embodiment of FIG. 1.
Figure 8:
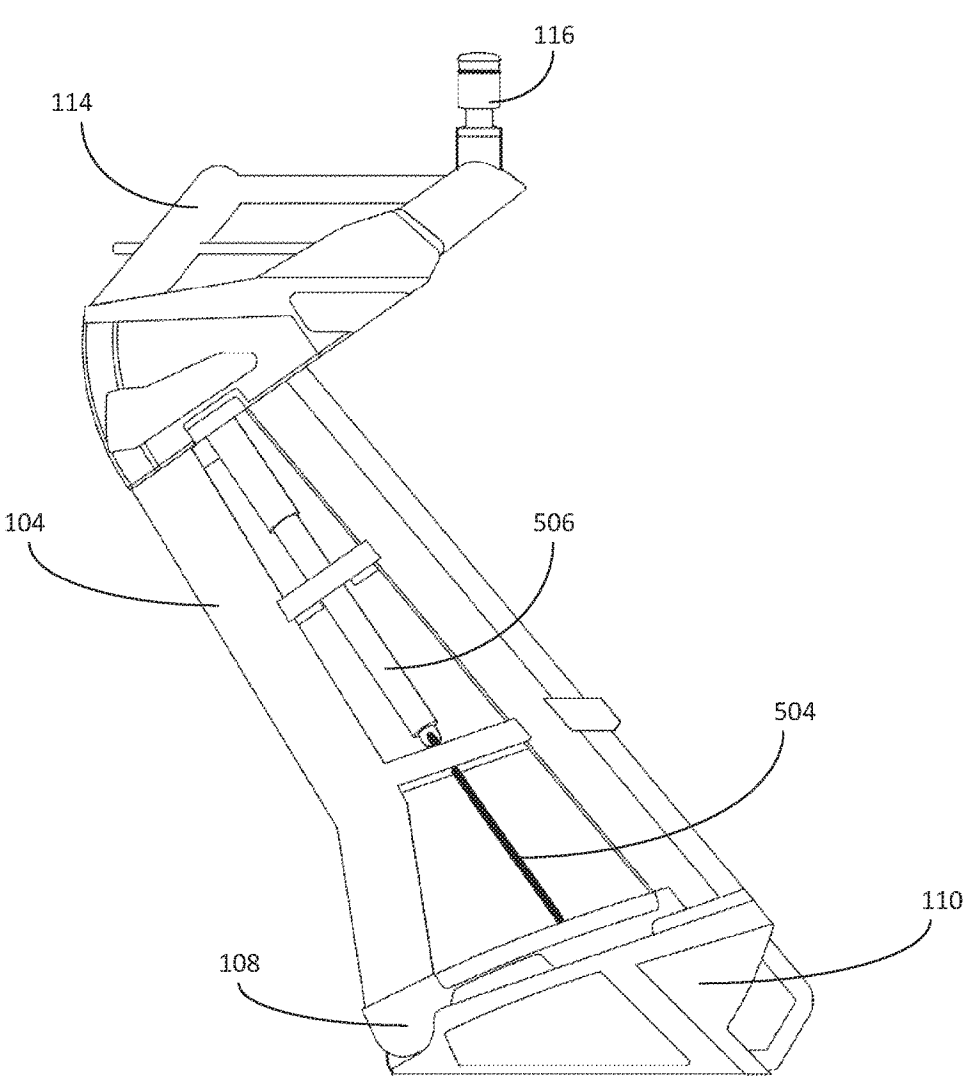
FIG. 8 is a side view of the illustrative example embodiment of the boat tower of FIG. 5 in the raised position.
Figure 9:
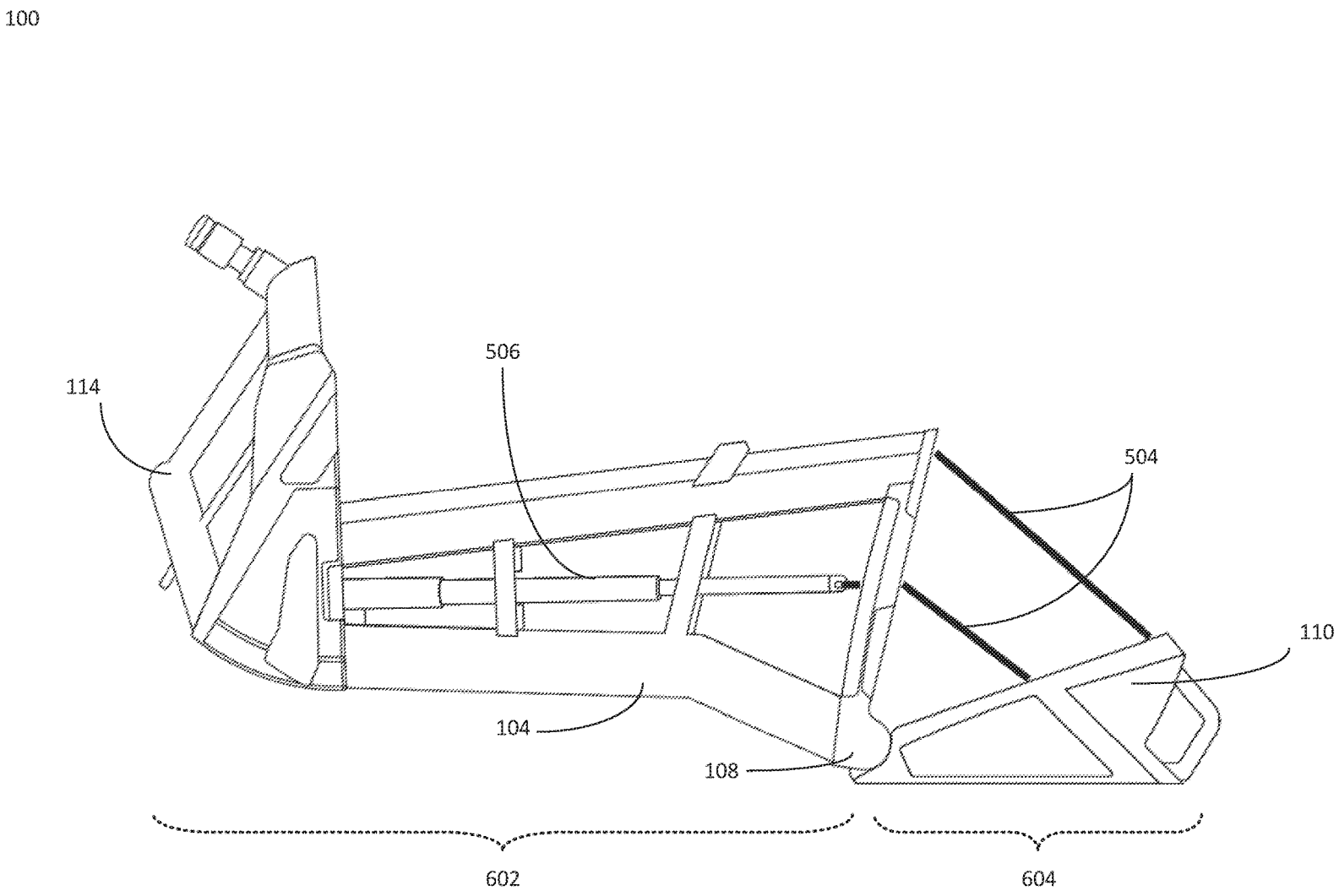
FIG. 9 is a side view of the illustrative example embodiment of the boat tower of FIG. 5 in the folded position.

In some implementations, center of gravity 700 of tower 102 may be longitudinally displaced from pivotal connection 108 toward a direction of movement of tower 102 between first position 500 and second position 600. For example, and as generally shown in FIG. 7, center of gravity 700 of the portion of tower 102 above the pivot (e.g., folding portion 602 of tower) may be longitudinally displaced beyond the pivot in the desired direction for tower 102 to fold. For example, if tower 102 is desired to fold in an aft direction, center of gravity 700 of folding portion 602 of tower 102 may be disposed aft of the pivot, and the pivotal connection 108 may be oriented to provide aftward pivoting of the tower (i.e., the folding portion 602 may have freedom of movement in an aft direction). In a corresponding manner, if tower 102 is desired to fold forward, center of gravity 700 of folding portion 602 of tower 102 may be forward of the pivot, and the pivotal connection 108 may be oriented to provide forward pivoting of the tower (e.g., may not be constrained against forward pivoting, e.g. by the arrangement of the pivot relative to the bases). Consistent with such a configuration, the weight of tower 102, acting through center of gravity 700 of folding portion 602 of tower 102, may tend to urge tower 102 toward folded position (i.e., second position 600).

Continuing with the foregoing, in which center of gravity 700 of folding portion 602 of tower 102 may be longitudinally displaced beyond the pivot in the desired direction of folding of tower 102, the weight of folding portion 602 of tower 102, acting through center of gravity 700, may urge tower 102 toward the folded position. The magnitude, or extend, to which tower 102 may be urged toward the folded position may be based upon, at least in part, the amount of the longitudinal displacement of center of gravity 700 beyond the pivot (e.g., the lever arm created by the longitudinal displacement of the center of gravity relative to the pivot).

It will be appreciated that, typically, the pivot may be disposed on the edge of first side support 104 and second side support 106, and/or on the edge of first side support 104 and second side support 106 and respective base 110, 112, in the direction that tower 102 is desired to fold. As such, the base may not inhibit folding of the tower. However, in other configurations, the pivot may not be disposed on the edge of the side supports and respective bases. In such configuration, the side supports and respective bases may have a geometry that may allow pivotal movement of the side supports relative to the respective bases in the desired folding direction. It will be appreciated that other configurations may be implemented, with appropriate clearances being provided between folding portion 602 of tower 102 and stationary portion 604 of tower 102 and/or respective bases 110, 112.

In some implementations, the flexible tether may extend on a longitudinally opposed side of pivotal connection 108 relative to center of gravity 700 of folding portion 602 of tower 102. For example, actuator 506 and the flexible tether (i.e., linkage 504) may be placed in tension countering the weight of folding portion 602 of tower (e.g., acting through center of gravity 700 of folding portion 602 of tower 102). From a raised position of tower 102, actuator 506 may be extended, thereby increasing the length of actuator 506 and the flexible tether, and allowing tower 102 to move toward a folded position under the urging of the weight of tower 102 (e.g., acting through center of gravity 700 which is longitudinally disposed from the pivot in the vector direction of the desired fold). Actuator 506 may be configured to extend sufficiently to allow desired degree of pivotal movement of tower 102, e.g., such that tower 102 can achieve a desired folded position. From the folded position, actuator 506 may be retracted, e.g., to shorten the length of actuator 506 and the flexible tether, and thereby pull tower 102 from the (partially and/or fully) folded position toward the raised position.

Figure 6:
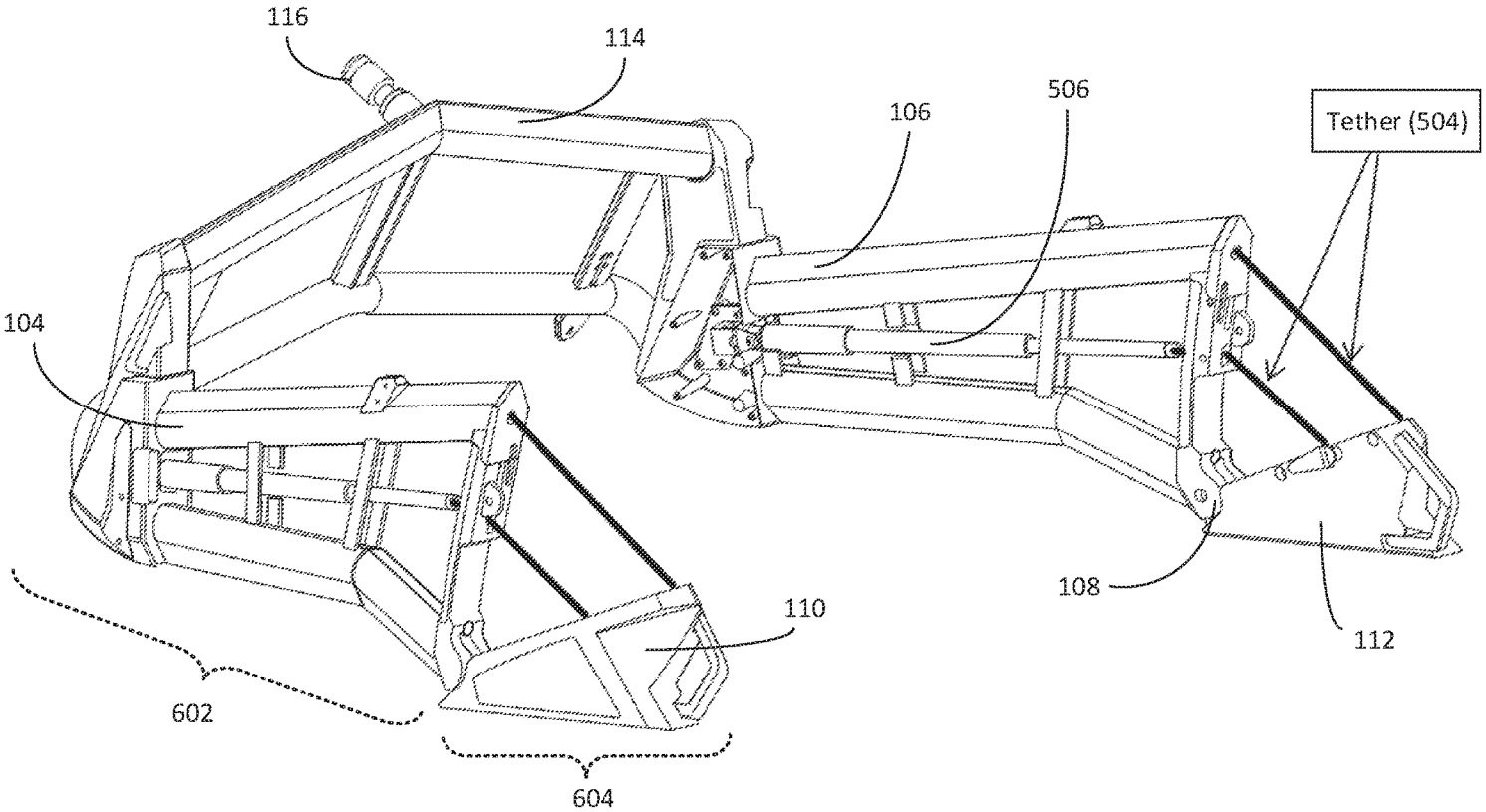
FIG. 6 shows the illustrative example embodiment of the boat tower of FIG. 5 in a folded position.

As shown at least in FIG. 6, in some embodiments the flexible tether may act through a pulley associated with stationary portion 604 of tower 102, e.g., such that the flexible tether may extend back toward, and be coupled with, folding portion 602 of tower 102. Various additional and/or alternative arrangements may be employed, including the use of multiple pulleys to effectuate a desired mechanical advantage, e.g., which may allow the use of actuator 506 to be configured to exert a relatively smaller raising force.

As generally discussed above, folding portion 602 of tower 102 may be moved to be positioned in a raised configuration in first position 500. For example, an illustrative example embodiment of tower consistent with the present disclosure is shown, in which FIGS. 1-4 may variously depict views of the example tower in a raised configuration. Further, folding portion 602 of tower 102 may be moved to be positioned in a folded configuration in second position 600. For example, an illustrative example embodiment of tower 102 consistent with the present disclosure is shown, in which FIGS. 5-8 may variously depict views of the example tower 102 showing an example embodiment of an actuation configuration that may be implemented to move tower 102 between the raised position and the lowered, or folded, positions.

Consistent with the foregoing, first side support 104 and second side support 106 may be configured to position center section 114 at a first height above a deck of the boat in first position 500, and at a second height above the deck of the boat in second position 600. For example, the two side supports may be foldable to raise and lower center section 114 between a lowered position at a first height above the deck of the boat and a raised position at a second height above the deck of the boat. In some implementations, the second height may be a greater distance from the deck of the boat than the first height.

In some implementations, first side support 104 and second side support 106 may be configured to position center section 114 at a plurality of heights relative to the deck of the boat as tower 102 moves between first position 500 and second position 600. For example, the two side supports may be foldable to position center section 114 at a plurality of heights between the lowered, first height, and the raised, second height, including discrete incremental heights and/or continuously variable heights.

In some implementations, towing structure 100 may include tower 102 configured to be mounted to a boat. Tower 102 may include first side support 104 and second side support 106. Each of the first side support 104 and second side support 106 may be pivotally connected 108 to a respective base 110, 112. For example, attachment points may be integrated into the side support sections of tower 102 and may be used to mount accessories. Removable (or openable) access plates may be mounted to the side support sections for access to actuators 506, service and assembly. The side sections may be angled into the inside of the boat (for example, but not limited to, 2 degrees to 15 degrees) creating an arch affect, thereby adding strength to tower 102. First side support 104 and second side support 106 and center section 114 may include mounting points for audio (speaker) cans of a custom shape, however, in some implementations, center section 114 of tower 102 may have integrated speakers. First side support 104 and second side support 106 may have attachment points for a sun shade (Bimini system). First side support 104 and second side support 106 or respective bases 110, 112, of each of the two side support sections may include personalized storage compartments. Each of the two side support sections may mount to the deck of the boat on both port and starboard attachment points (i.e., mounts and/or bases).

In some implementations, towing structure 100 may include actuation assembly 502. Actuation assembly 502 may include linkage 504 extending between folding portion 602 of tower 102 and at least one of respective bases 110, 112, for moving tower 102 between first position 500 and second position 600. Actuation assembly 502 may further include actuator 506 coupled to folding portion 602 of tower 102. The coupling between actuator 506 and folding portion 602 may provide pivotal movement between actuator 506 and folding portion 602 as tower 102 moves between first position 500 and second position 600.

For example, any suitable electrical, hydraulic, pneumatic, mechanical, and manual mechanisms (and/or combinations of two or more different mechanisms) may be utilized to release tower 102 or arch like structure to effectually lower and to raise tower 102, including, but not limited to, actuators, rack and pinion mechanisms, screw drive mechanisms, pulley and cable/rope mechanisms, pneumatic/hydraulic pistons, and the like. For example, tower sections may utilize actuators only fixed at one point and secondary attachment is floating and attached to a moving mechanical system.

In some implementations, linkage 504 may include a flexible tether coupled to and extending between actuator 506 and respective base 110, 112, of tower 102. For example, powered actuators involved in raising and lowering a tower assembly may be included in one or both of the port and starboard side sections of tower 102 itself. Continuing with the foregoing, tower 102 may include a switch built into tower 102 to operate actuator 506 that will activate the raising and lowering of tower 102. The controls for raising and lowering tower 102 may be positioned on one or more boat control panels (e.g., helm console, or other control panels) or accessible areas for actuating tower 102 for raising or lowering the structure. The controls may be built into a computer display/chart plotter or other instrument of the boat and activated by the driver from a helm area of the vessel. It will be appreciated that various interlocks and/or safeties may be included to prevent/reduce the likelihood of accidental or unsafe actuation of the folding mechanism.

While the illustrated embodiment may depict actuator 506 configured for linearly extending and retracting, it will be appreciated that various additional and/or alternative mechanisms may be utilized that may release tower 102 for folding under its own weight (in a controlled fashion), and to take-up the flexible tether for raising tower 102.

In some implementations, center of gravity 700 of tower 102 may be longitudinally displaced from pivotal connection 108 toward a direction of movement of tower 102 between first position 500 and second position 600. For example, center of gravity 700 of tower 102 may be placed at some distance away from the pivot point in the same vector of the desired fold. In some implementations, the flexible tether may extend on a longitudinally opposed side of pivotal connection 108 relative to center of gravity 700 of folding portion 602 of tower 102. In some implementations, folding portion 602 of tower 102 is positioned in a raised configuration in first position 500. In some implementations, folding portion 602 of tower 102 may be positioned in a folded configuration in second position 600.

In addition to the described arrangement for raising and lowering tower 102, various mechanisms and/or arrangements may be included for securing tower 102 in the raised and/or in the folded positions. For example, when tower 102 is in the folded position, folded portion 602 of tower 102 may be secured to reduce and/or prevent bouncing (e.g., pivoting to a partially raised position and then back to a more folded position), for example due to movement of the boat, either while traveling on the water or during transport (e.g., via trailer). Similarly, in some embodiments, various locking mechanisms may be utilized to secure tower 102 in the raised position. Such locking mechanisms may reduce the likelihood of tower 102 partially and/or fully folding as a result of a failure of actuator 506 or the flexible tether, or inadvertent actuation of the fold mechanism (e.g., by accidental actuation of a switch controlling the folding system).

In some implementations, towing structure 100 may include tower 102 configured to be mounted to a boat. Tower 102 may include first side support 104 and second side support 106. Each of first side support 104 and second side support 106 may be pivotally connected 108 to respective base 110, 112. Tower 102 may include a lock system to latch tower 102 in a raised (i.e., upright) position and/or in the folded position. Tower 102 may include interior lighting facing downward into the cockpit of the vessel. Tower 102 may also include integrated navigation lights for the boat, such as an all-round navigation light. Tower 102 may be used for various tow watersports when in the raised (i.e., upright) position. The folded (i.e., lowered) position of tower 102 may solve the need for lowering tower 102 for storage, travel, cover of the vessel. Tower 102 may lower and be completely above the deck of the boat in lowered position.

In some implementations, towing structure 100 may include actuation assembly 502. Actuation assembly 502 may include linkage 504 extending between folding portion 602 of tower 102 and at least one of respective bases 110, 112, for moving tower 102 between first position 500 and second position 600. Actuation assembly 502 may further include actuator 506 coupled to folding portion 602 of tower 102. The coupling between actuator 506 and folding portion 602 may provide pivotal movement between actuator 506 and folding portion 602 as tower 102 moves between first position 500 and second position 600. For example, the position of actuator 506 may be manually adjusted (e.g., via a threaded rod or other suitable adjustment mechanism or arrangement) to adjust the position and increase or decrease slack in the secondary mechanical system and affect the overall fold distance. In some implementations, linkage 504 may include a flexible tether coupled to and extending between actuator 506 and respective base 110, 112, of tower 102.

The terminology used herein is for the purpose of describing particular implementations only and is not intended to be limiting of the disclosure. As used herein, the singular forms "a", "an" and "the" are intended to include the plural forms as well, unless the context clearly indicates otherwise. As used herein, the language "at least one of A, B, and C" (and the like) should be interpreted as covering only A, only B, only C, or any combination of the three, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents (e.g., of all means or step plus function elements) that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to explain the principles of the disclosure and the practical application, and to enable others of ordinary skill in the art to understand the disclosure for various implementation(s) with various modifications and/or any combinations of implementation(s) as are suited to the particular use contemplated.

A number of implementations have been described. Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. An apparatus comprising:

a tower configured to be mounted to a boat, the tower comprising a first side support and a second side support, wherein each of the first side support and the second side support is pivotally connected at a respective base; and an actuation assembly, wherein the actuation assembly comprises a linkage extending between a folding portion of the tower and at least one of the respective bases for moving the tower between a first position, comprising a raised configuration, and a second position, comprising a folded configuration, by pivoting the tower away from the respective bases via a pivotal connection;

wherein the actuation assembly further comprises an actuator coupled to the respective base of the tower and also secured in series with the linkage, and wherein the linkage comprises a flexible ether that extends from the actuator, loops through the folding portion of the tower, and then returns to a connection with the respective base of the tower.

2. The apparatus according to claim 1 wherein the first side support and the second side support are respectively positioned at opposing ends of a center section of the tower.

3. The apparatus according to claim 1, wherein the actuation assembly is disposed in at least one of the first side support and the second side support.

4. The apparatus according to claim 1, wherein the actuation assembly further comprises an actuator directly coupled to and disposed within the folding portion of the tower, a coupling between the actuator and the folding portion providing pivotal movement between the actuator and the folding portion as the tower moves between the first position and the second position.

5. The apparatus according to claim 1 wherein a center of gravity of the tower is longitudinally displaced from the pivotal connection toward a direction of movement of the tower between the first position and the second position.

6. The apparatus according to claim 5 wherein the linkage extends on a longitudinally opposed side of the pivotal connection relative to the center of gravity of the folding portion of the tower.

7. The apparatus according to claim 2 wherein the first side support and the second side support are configured to position the center section at a first height above a deck of the boat in the first position, and at a second height above the deck of the boat in the second position.

8. The apparatus according to claim 7 wherein the first height is a greater distance from the deck of the boat than the second height.

9. The apparatus according to claim 8 wherein the first side support and the second side support are configured to position the center section at a plurality of heights relative to the deck of the boat as the tower moves between the first position and the second position.

10. An apparatus comprising:

a tower configured to be mounted to a boat, the tower comprising a first side support and a second side support, wherein each of the first side support and the second side support is pivotally connected via a pivotal connection to a respective base; and an actuation assembly, wherein the actuation assembly comprises a linkage extending between a folding portion of the tower and at least one of the respective bases for moving the tower between a first position, comprising a raised configuration, and a second position, comprising a folded configuration, by pivoting the tower away from the respective bases, wherein the actuation assembly further includes an actuator coupled to the folding portion of the tower, wherein the linkage comprises a flexible tether coupled to and extending between the actuator and the respective base of the tower, and wherein the flexible ether is looped through the respective base of the tower and returns to a connection with the folding portion of the tower.

11. The apparatus according to claim 10 wherein a center of gravity of the tower is longitudinally displaced from the pivotal connection toward a direction of movement of the tower between the first position and the second position.

12. The apparatus according to claim 11 wherein the flexible tether extends on a longitudinally opposed side of the pivotal connection relative to the center of gravity of the folding portion of the tower.

13. An apparatus comprising:

a tower configured to be mounted to a boat, the tower comprising a first side support and a second side support, wherein each of the first side support and the second side support is pivotally connected to a respective base; and an actuation assembly extending between the tower and at least one of the respective bases for moving the tower between a first position, comprising a raised configuration, and a second position, comprising a folded configuration, by pivoting the tower away from the respective bases via a pivotal connection, the actuation assembly including an actuator coupled to a flexible tether;

wherein the flexible tether is at least one of: connected in two ways to the tower and therebetween is looped through one base of the two bases; and connected in two ways to the one base of the two bases and therebetween is looped through the tower.

14. The apparatus according to claim 13 wherein a center of gravity of the tower is longitudinally displaced from the pivotal connection toward a direction of movement of the tower between the first position and the second position.

* * * * *